United States Patent [19]

Ikehata et al.

[11] 4,415,276

[45] Nov. 15, 1983

[54] ELECTRONIC TIMEPIECE

[75] Inventors: Yukio Ikehata; Kenichi Ono, both of Tokyo, Japan

[73] Assignee: Kabushiki Kaisha Daini Seikosha, Japan

[21] Appl. No.: 295,010

[22] Filed: Aug. 21, 1981

[30] Foreign Application Priority Data

Aug. 25, 1980 [JP] Japan ..... 55-116737

[51] Int. Cl.[3] ..... G04C 9/00

[52] U.S. Cl. ..... 368/187; 368/70; 368/79

[58] Field of Search ..... 368/69, 70, 76, 79, 368/80, 82-84, 184-189, 29, 30, 71

[56] References Cited

U.S. PATENT DOCUMENTS

| | | | |
|---|---|---|---|
| 3,889,460 | 6/1975 | Yasukawa et al. | 368/185 X |
| 4,128,993 | 12/1978 | Maeda et al. | 368/187 |
| 4,246,602 | 1/1981 | Sekiya et al. | 368/187 X |
| 4,258,431 | 3/1981 | Sekiya et al. | 368/187 X |
| 4,277,840 | 7/1981 | Sekiya et al. | 368/187 X |
| 4,308,607 | 12/1981 | Sekiya et al. | 368/184 X |

*Primary Examiner*—Ulysses Weldon

*Attorney, Agent, or Firm*—Robert E. Burns; Emmanuel J. Lobato; Bruce L. Adams

[57] ABSTRACT

An electronic timepiece has a timepiece standard generator, a frequency divider having a resettable terminal, a circuit for controlling an optically displaying device connected to the frequency divider, a circuit for controlling a hand displaying device connected to the frequency divider, a below second linking control circuit for detecting first the content of the frequency divider in response to the operation of either first switch for resetting to zero the digit of second of the optically displaying device or second switch for initiating to act the hand displaying device and for resetting next to zero the digit of second of the optically displaying device and initiating to act the hand displaying device after the time adjustment of the hand displaying device respectively. At the time of detection of a below second linking control circuit, the below second linking control circuit controls to advance by one second on the hand displaying device if the content of the frequency divider is 0.5 seconds and over at the resetting state of second-digit of the optically displaying device and controls to advance by one second on the optically displaying device if the content of the frequency divider is 0.5 seconds and over at the stepping state of the hand displaying device, whereby after the adjustment of either the optically displaying device or the hand displaying device, the time indication of the optically displaying device is linked to the time indication of the hand displaying device within 0.5 seconds.

12 Claims, 7 Drawing Figures

ELECTRONIC TIMEPIECE

BACKGROUND OF THE INVENTION

The present invention relates to a time adjusting means for an electronic timepiece having both a hand displaying type device and an optically displaying device.

In the prior art, there are two methods generally used for adjusting the time of an electronic timpiece having a hand displaying device and an optically displaying device. One method is a method in which the adjusting operations for the hand displaying device and the optically displaying device are independently carried out, and the other method is a method in which the adjusting operations are carried out in synchronization for units of a second below a unit of a minute. For example, there is a time-adjusting method in which 30 seconds and over is counted as a minute and 29 seconds or less is ignored and not counted in the optically displaying device, and the same operation that 30 seconds and over is counted as a minute and 29 seconds or less is ignored and not counted, is also carried out in the hand displaying device by a quick feeding of forward or reverse drive pulses to a stepping motor in synchronization with the adjusting operation of the optically displaying device. This method will be referred to as "a second linking" time-adjusting method, and on the other hand, the method of the present invention will be referred to as "a below second linking" time-adjusting method. Also, there is another method wherein a counter for counting time units below a second (fractions of a second) is reset when a correction for the second in the hand displaying device and the optically displaying device is carried out.

If the timepiece is of the type in which the hand displaying device is operated independently of the operation of the optically displaying device, no specific interconnecting arrangement is required, and the arrangement can be simple so that in this regard it is advantageous that the hand displaying device can be adjusted independently of the adjustment of the optically displaying device. However, in such timepieces the movement of the second hand of the hand displaying device is not necessarily coincident with the time indicated by the figures displayed by the optical displaying device and this is a serious drawback.

In addition, in the case of a timepiece having an alarm function which is performed in the optically displaying mode, the driving of the alarm buzzer is often carried out at the same time as the driving of a motor. Therefore, it is disadvantageous if the motor does not move because the battery voltage is lowered due to an increase of the internal resistance of the battery under low temperature conditions.

Although the value of the timepiece is improved when the time indicated by the second hand is coincident with the time indicated by the figures of the seconds digit when the second linking is employed, a device for detecting the position of the second hand or a particular operation for obtaining the coincidence between the indications of the second hand and the seconds digit at the initial setting time is required so that a relatively complex operation is required.

Of course, it is impossible to use these two timepieces as completely separate timepieces in the display of seconds.

The time delay of one second may be produced at a maximum depending upon the reset timing, when the counter for counting the time not more than one second is merely reset. For example, when 30/60 seconds and over is counted as a second and 29/60 seconds or less is not counted and dropped in the optically displaying device, if the counting result in the digit of the $10^{-1}$ seconds is 0.9 seconds, it follows that the second hand moves after 1.9 seconds have elapsed since the previous movement.

SUMMARY OF THE INVENTION

An object of the present invention is to eliminate the aforementioned drawbacks and to provide an electronic timepiece wherein the time indicated by the second hand of the hand displaying device is coincident with the time displayed by the figure of the seconds digit of the optically displaying device without a complex operation.

Another object of the present invention is to provide an electronic timepiece having a switch for time adjustment of an optically displaying device and a switch for time adjustment of a hand displaying device in which after the time adjustment of either the optically displaying device or the hand displaying device the time indication of the optically displaying device is linked to the time indication of the hand displaying device within 0.5 seconds.

Still another object of the present invention is to provide an electronic timepiece comprising a time standard generator, a frequency divider for receiving the output signal from the time standard generator and having resettable means for resetting the frequency divider, first control means connected to the frequency divider and for controlling an optically displaying device, second control means connected to the frequency divider for controlling a hand displaying device, third control means connected to the resettable means of the frequency divider for detecting the content of the frequency divider, and an input circuit means connected to the third control means and having a switching means including at least one of first switch for the optically displaying device and second switch for the hand displaying device.

DETAILED DESCRIPTION OF THE PREFERRED EMBODIMENT

One embodiment of the present invention will now be described in more detail in conjunction with the attached drawings. In addition, in this embodiment, the reference value for either discarding or raising to the next time those time units below one second, i.e. unit fractions of the digit of $10^{-1}$ seconds, is 5/10 seconds, however, this value is merely example and the reference value is not limited to the 5/10 seconds in this invention.

Figure 1:
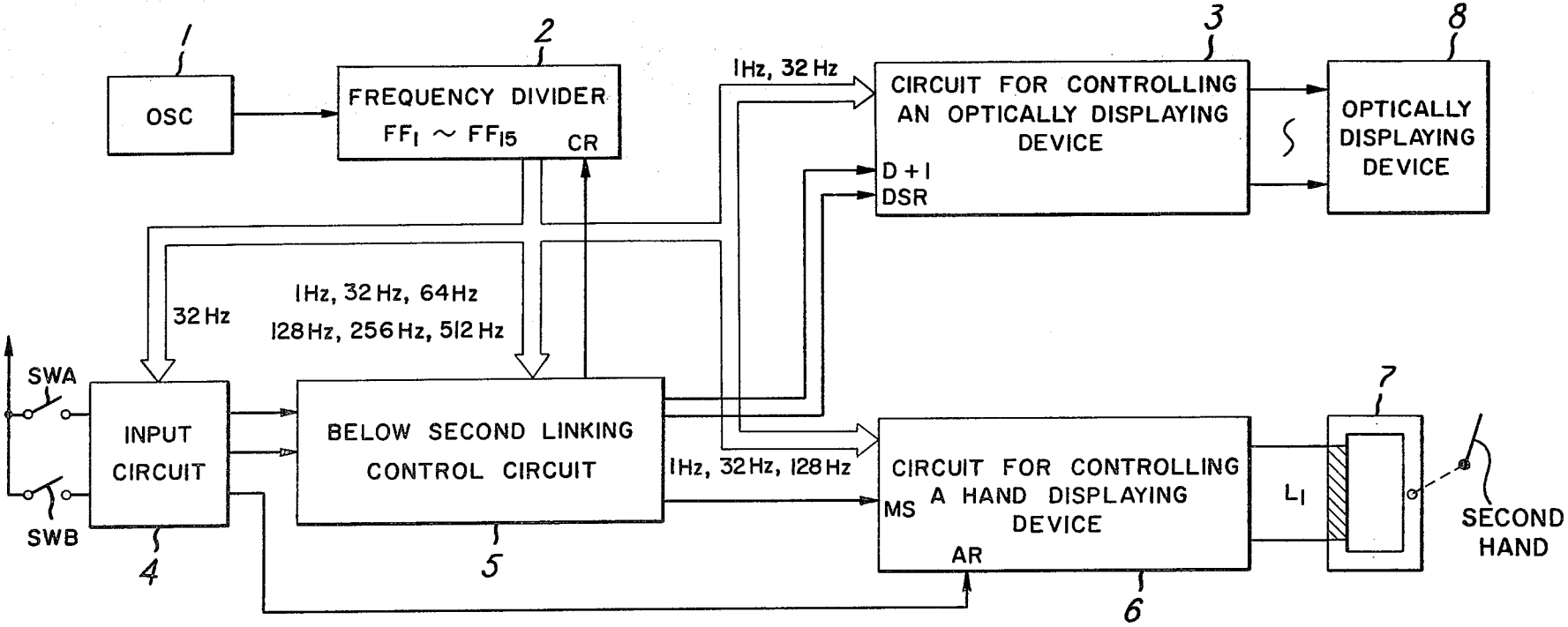
FIG. 1 is a block diagram of an embodiment of the present invention.
Figure 2A:
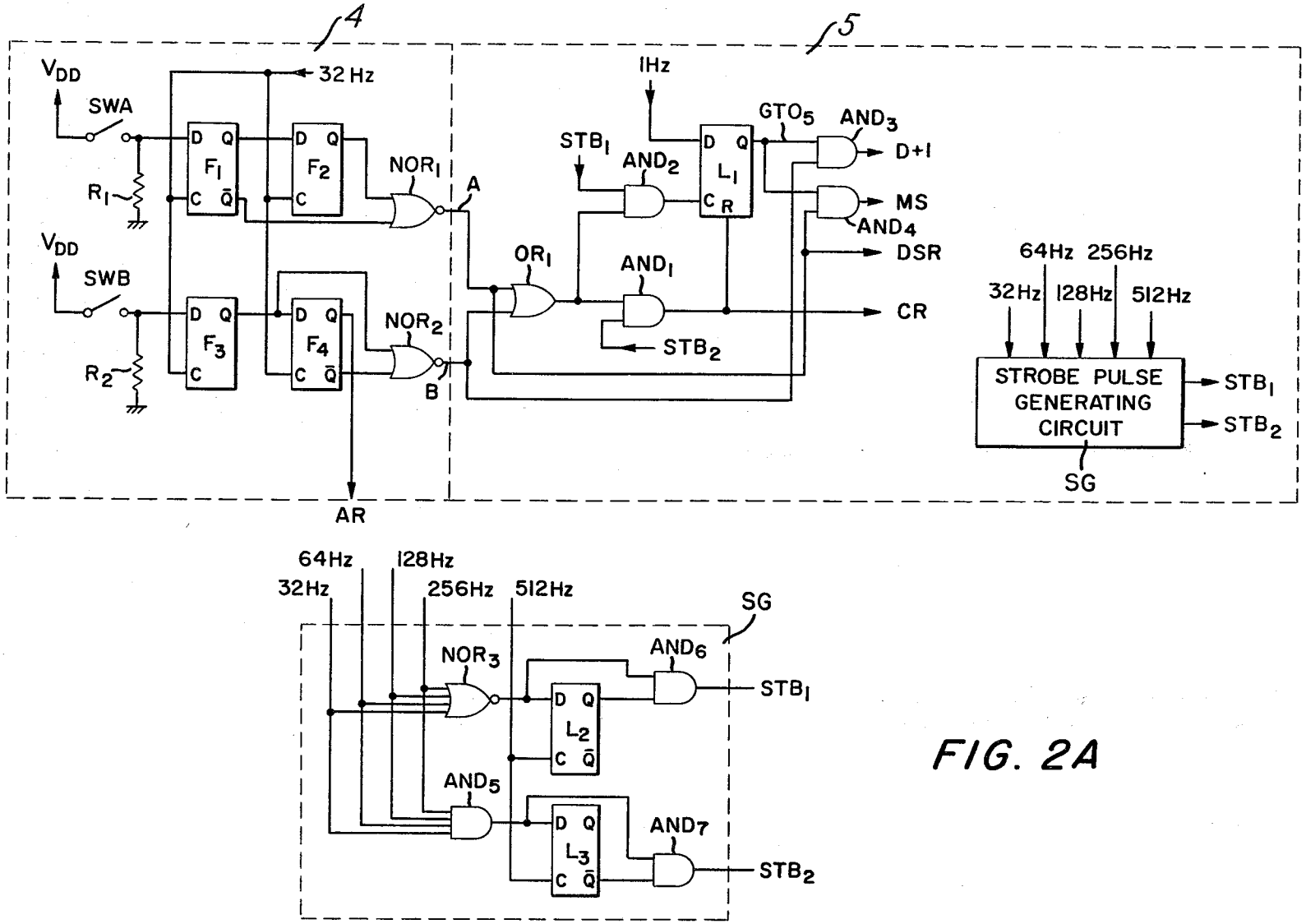
FIG. 2A is a circuit diagram of an input circuit and a circuit for linking the digits indicating a time less than minute which are shown in the embodiment of FIG. 1.
Figure 2B:
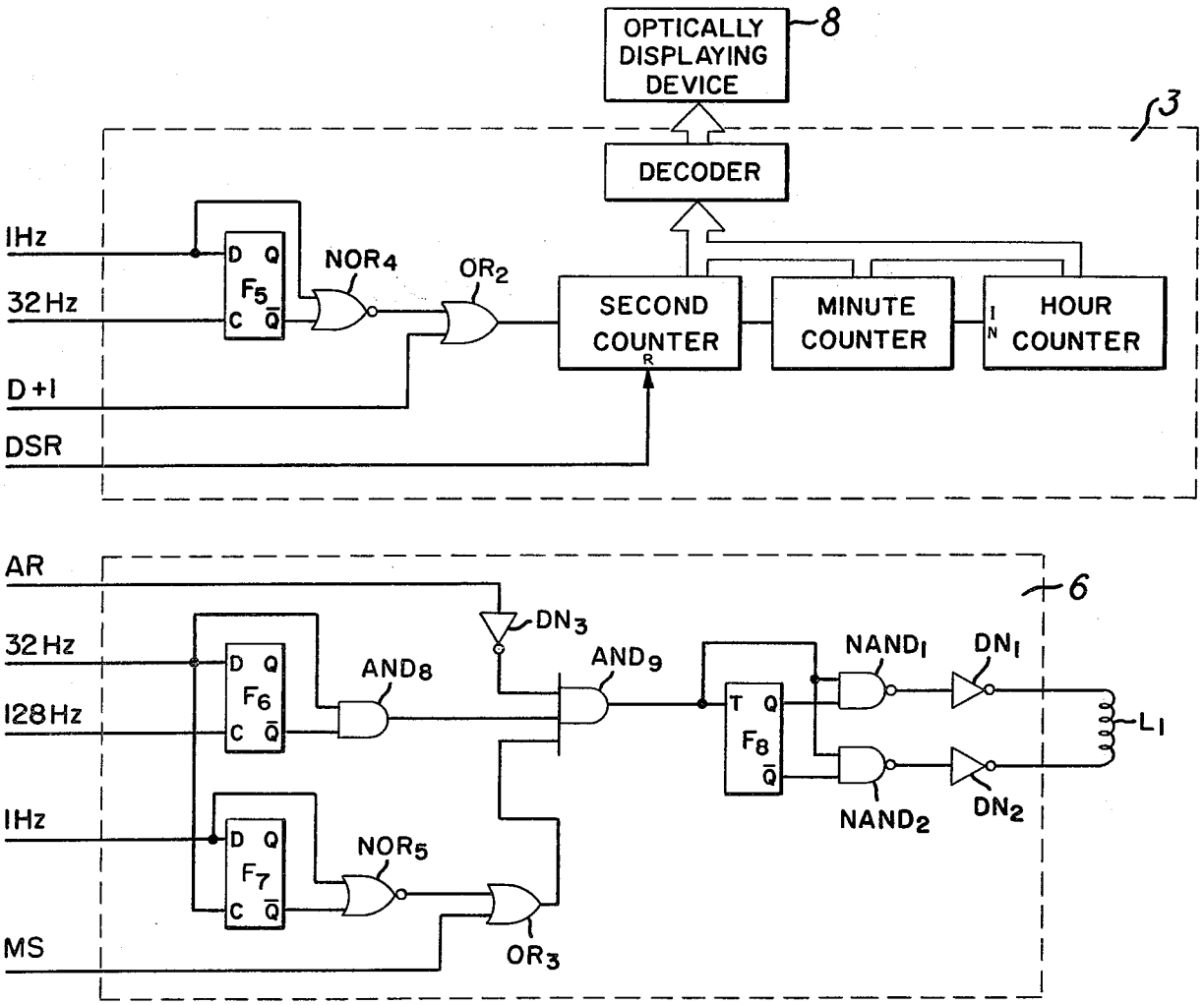
FIG. 2B is a circuit for controlling an optically displaying device and a circuit for controlling a hand displaying device.

FIG. 1 is a block diagram of one embodiment of the present invention. An output of a 32768 Hz oscillator 1 is connected to a resettable frequency divider 2. The output signal from the oscillator 1 is divided in frequency by successive stages $FF_1$ to $FF_{15}$ of the frequency divider 2 to produce a 1 Hz signal. The changing of the indication of the seconds digit and the movement of a second hand are synchronized with the timing of the trailing edge of the 1 Hz signal from the divider 2.

The output of the frequency divider 2 is connected to a circuit 3 for controlling an optically displaying device, an input circuit 4, a below second linking control circuit 5 and a circuit 6 for controlling a hand displaying device. The circuit 3 for controlling an optically displaying device operates so as to produce an output signal indicating the time in accordance with the output signal from the divider 2 and to supply it to an optically displaying device 8. Since such a controlling circuit is known in the prior art, the detailed description thereof will be omitted. Moreover, the circuit 3 for controlling the optically displaying device 8 functions to reset the seconds digit and to add one second to the seconds digit. The input circuit 4 receives the output signals from a switch SWA and a switch SWB to shape the waveform thereof and transmits a switch signal to the below second linking control circuit 5 and the circuit 6 for controlling a hand displaying device. The seconds digit of the optically displaying device is reset to "00" seconds operation of the switch SWA in a first time-setting mode and the hand displaying device is reset by the operation of the switch SWB. The below second linking control circuit 5 receives the switch signal from the input circuit 4 and detects whether the value of the digit of $10^{-1}$ seconds is equal or not equal to, or more than, a reference value, for example, 5/10 seconds. In accordance with the result of the detection, the circuit 5 supplies a reset signal DSR for resetting the seconds digit or a +1 signal D+1 for advancing the display time by one second to the circuit 3, or the circuit 5 supplies a motor driving signal MS for moving the second hand by one second and a counter reset signal CR for resetting a part of the frequency divide 2 to the circuit 6. The circuit 6 for controlling a hand displaying device receives the output signal AR from the input circuit 4 or the output signal MS from the circuit 5 for controlling the linking of the digits indicating a time less than a minute, and synthesizes a pulse for driving a stepping motor 7 which is connected through suitable gearing to rotationally drive the second hand. When the output signal from the input circuit 4 or the output signal from the circuit 5 is not produced, the pulse for driving the stepping motor 7 is synthesized in synchronization with the timing of the trailing edge of the 1 Hz signal from the frequency divider 2 in the customary manner. The output of the circuit 3 for controlling an optically displaying portion is connected to the optically displaying device 8. The output of the circuit 6 for controlling a hand displaying device is connected to the stepping motor 7 which operates a set of hands including a second hand.

The operation of the below second linking control circuit 5 will now be described in conjunction with FIGS. 2A and 2B, and FIGS. 3A to 3D.

A circuit having flipflops $F_1$ and $F_2$ and a NOR gate $NOR_1$ is a circuit for outputting a one shot pulse A from the NOR gate $NOR_1$ in synchronization with the output signal of 32 Hz from the frequency divider 2 when the switch SWA is switched ON. A circuit having flip-flops $F_3$ and $F_4$ and a NOR gate $NOR_2$ is a circuit for outputting a one shot pulse B from the NOR gate $NOR_2$ in synchronization with the output signal of 32 Hz from the frequency divider 2 when the switch SWB is switched over from its ON position to its OFF position. The output Q of the flip-flop $F_4$ is applied as a stepping motor driving inhibit signal AR to the circuit 6 for controlling a hand displaying portion. The driving of the stepping motor 7 is inhibited when the level of the stepping motor driving inhibit signal AR is "H". Resistors $R_1$ and $R_2$ are used for preventing the D inputs of the flip-flops $F_1$ and $F_3$ from floating. One terminal of the switches SWA and SWB is connected to a $V_{DD}$ power source. The below second linking controlling circuit 5 shown in FIG. 2 will be described. An OR gate $OR_1$ carries out an OR operation between the pulses A and B, and the output of the OR gate $OR_1$ is connected to one input terminal of AND gates $AND_1$ and $AND_2$. A strobe pulse $STB_1$ is applied to the other input terminal of the AND gate $AND_2$ and the output of the AND gate $AND_2$ is connected to a clock input terminal for a latch $L_1$. The D input terminal of the latch $L_1$ is connected to receive the 1 Hz signal from the frequency divider 2. When the pulse A or B becomes high, the 1 Hz output from the frequency divider 2 is latched in accordance with the timing or the strobe pulse $STB_1$, and the Q output of the latch $L_1$ becomes a detection signal GTO5 for discarding/raising the time displaying the digit of $10^{-1}$ seconds. That is, the detection signal GTO5 indicates whether or not the value of the digit of $10^{-1}$ seconds at the time of the occurrence of the pulse A or B is equal to or more than 5/10 seconds. If the value of the digit of $10^{-1}$ seconds is not less than 5/10 seconds at the time of occurrence of the pulse A or B, the level of the detection signal GTO5 will be "H". A strobe signal $STB_2$ is applied to the other input terminal of the AND gate $AND_1$. At the time of occurrence of the pulse A or B, the counter reset signal CR for resetting both the latch $L_1$ and a part of the frequency divider 2 is produced in response to the timing of the strobe pulse $STB_2$. The output signal from an AND gate $AND_3$ is the +1 signal D+1 the level of which becomes high only when both levels of the detection signal GTO5 and the pulse B becomes high. The output signal from an AND gate $AND_4$ is the motor driving signal MS the level of which becomes high only when both levels of the detection signal GTO5 and the pulse A become high. The pulse A is applied as the second digit reset signal DSR to the circuit 5 for controlling the optically displaying device 8.

Figure 3A:
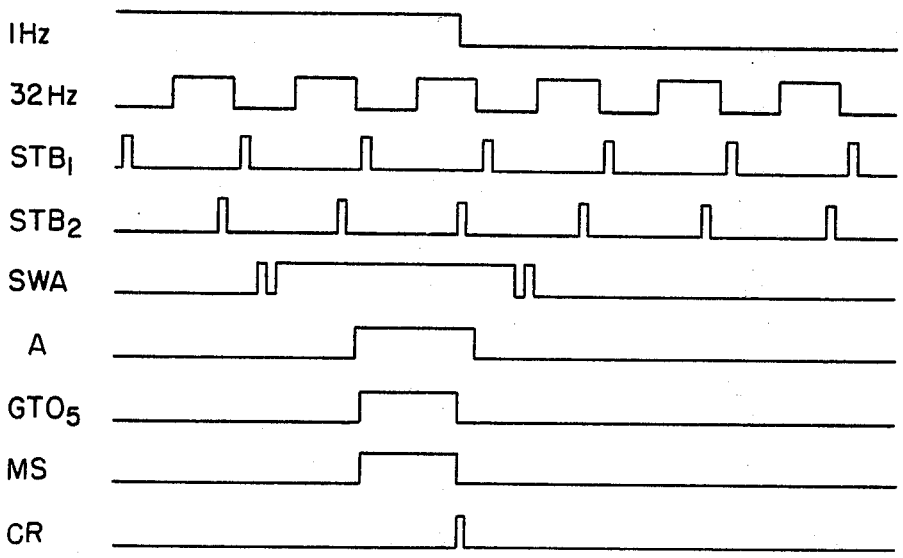
FIGS. 3A, 3B, 3C and 3D are timing charts showing the waveforms of the circuitry of the present invention.

FIG. 3A shows timing charts in the case that the switch SWA is depressed so that the pulse A is produced to reset the optically displaying device to "00" seconds at the time when the time indicated by the digit of $10^{-1}$ seconds is equal to or more than 5/10 seconds. In this case, the seconds digit is reset by the second digit reset signal DSR, and moreover the motor driving signal MS is produced since the level of the detection signal GTO5 is "H". Consequently, the stepping motor 7 is driven and the time indicated by the hands is advanced by one second. Therefore, in this case, it follows that, in the time indicated by the hands, the 5/10 seconds and over in the digit of $10^{-1}$ seconds is raised to one second.

Figure 3B:
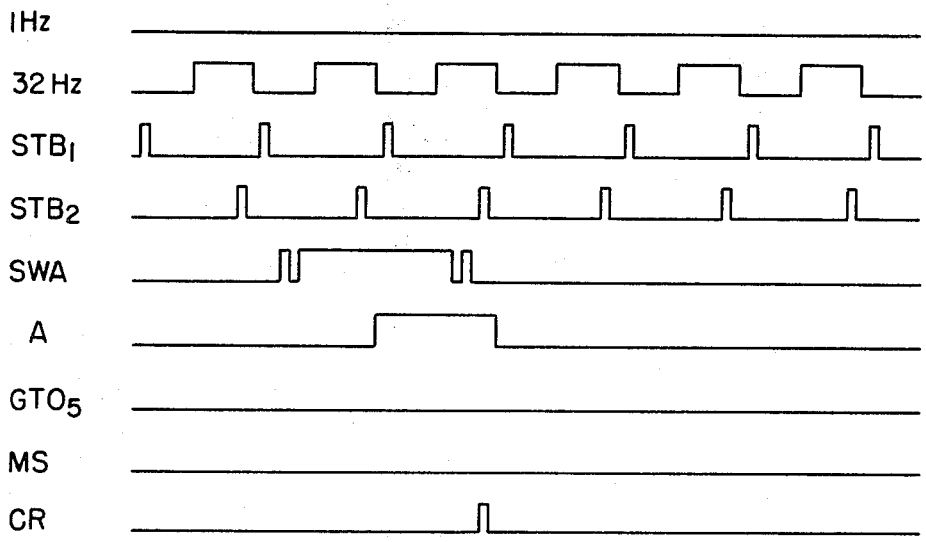

FIG. 3B shows timing charts in the case that the switch SWA is depressed so that the pulse A is produced at the time less than 5/10 seconds in the digit of $10^{-1}$ seconds. In this case, although the reset operation is carried out for the digits of second by the second digit reset signal DSR, since the level of the detection signal $GTO_5$ is "L", the motor driving signal MS is not produced so that the stepping motor 7 is not driven. Therefore, in this case, it follows that the time less than 5/10 seconds in the digit of $10^{-1}$ seconds is discarded in the time indicated by the hands.

Figure 3C:
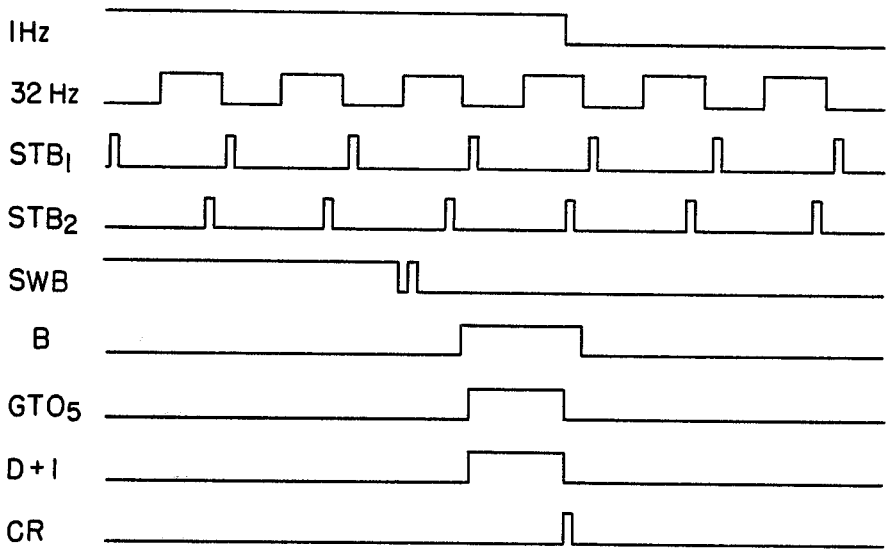
Figure 3D:
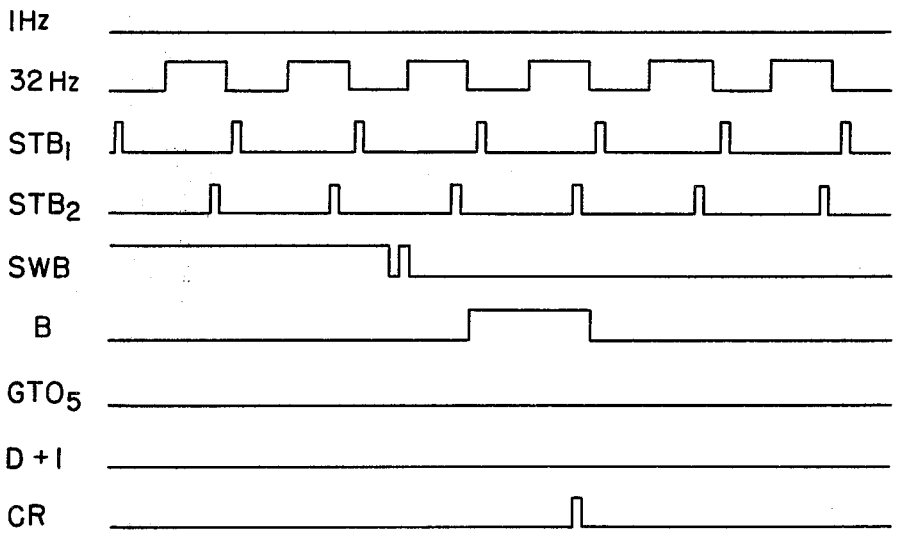

FIG. 3C shows timing charts in the case that the switch SWB is operated in such a way that the pulse B is produced at the time when the time indicated by the digit of $10^{-1}$ seconds is equal to or more than 5/10 seconds. In this case, the detection signal GTO5 is produced since the level of the +1 signal D+1 is "H", and the seconds digit is advanced by one second. Therefore, in this case, it follows that the 5/10 seconds and over in the digit of $10^{-1}$ seconds is discarded. In the foregoing description, one embodiment is described, however, the circuit is not limited to that of this embodiment.

As described above, according to the present invention, (1) The movement of the second hand of the hand type displaying device can be coincident with the display of the time indicated by the optical type displaying device without any specific interconnecting devices or complex operations thus increasing the value of the timepiece.

(2) Even if the alarm function is provided, the motor driving operation under low temperature condition will be assuredly carried out since the driving of the buzzer is not carried out at the same time of the motor driving.

(3) The time indicated by the hand type displaying device can be independently set irrespective of the time indicated by the optical type displaying device even in the setting of the seconds digit.

What is claimed is:

1. An electronic timepiece comprising: a time standard generator for generating a time standard output signal; a frequency divider for receiving the output signal from said time standard generator and having a resettable means and for producing a 1 Hz signal; first control means connected to said frequency divider to receive there from the 1 HZ signal for controlling an optically displaying device; second control means connected to said frequency divider to receive there from the 1 HZ signal for controlling a hand displaying device having a second hand; third control means connected to the resettable means of said frequency divider and including means for detecting the time of $10^{-1}$ seconds unit of said frequency divider and controlling said first control means and second control means in response to the content of said frequency divider; and input circuit means connected to said third control means and having switching means including at least one of a first switch for resetting the seconds indication of said optically displaying device to "00" seconds and a second switch for releasing the resetting state of said hand displaying device such that the content of said frequency divider is reset when one of the first switch and the second switch is operated and the seconds indication of said optically displaying device is linked to the seconds indication of said hand displaying device after one of the first switch and the second switch is operated.

2. An electronic timepiece as claimed in claim 1 wherein said third control means includes means for controlling said second control means to advance by one second said hand displaying device when said means for detecting the time of $10^{-1}$ seconds unit detects whether the content of said frequency divider is below ½ seconds or over ½ seconds in response to the operation of said first switch so that the second hand of said hand displaying device indicates "01" seconds one second after the operation of said first switch when said first switch is operated at a time when the content of the frequency divider is below ½ seconds.

3. An electronic timepiece as claimed in claim 1; wherein said third control means includes means for controlling said first control means to advance by one second said optically displaying device when said means for detecting the time of $10^{-1}$ seconds unit detects whether the content of said frequency divider is below ½ seconds or over ½ seconds in response to the operation of said second switch so that the seconds indication of said optically displaying device indicates "01" seconds one second after the operation of said second switch when said second switch is operated at a time when the content of the frequency divider is below ½ seconds.

4. In an electronic timepiece having an optical display device for displaying time information including seconds time units and having a hand display device for displaying time information including a movable second hand to display seconds time units: generating means for generating a time standard signal; resettable frequency dividing means for receiving and frequency dividing the time standard signal to produce frequency-divided output signals including a 1 Hz signal; circuit means connected to receive the output signals for controlling the optical display device and the hand display device to normally display time information; and time setting means operable in a first mode to set the optical display device to display "00" seconds within a predetermined time period of the time the hand display device normally displays "00" seconds and operable in a second mode to set the second hand of the hand display device to display "00" seconds within a predetermined time period of the time the optical display device normally displays "00" seconds.

5. An electronic timepiece according to claim 4; wherein the time setting means includes means for linking the display of seconds time units by the optical display device to the second hand after setting of the optical display device to display "00" seconds.

6. An electronic timepiece according to claim 4; wherein the time setting means includes means for linking the second hand to the display of seconds time units by the optical display device after setting of the hand display device to display "00" seconds.

7. An electronic timepiece according to claim 4; wherein the time setting means is operable in the first mode to set the optical display device to display "00" seconds within ½ seconds of the time the hand display device normally displays "00" seconds and is operable in the second mode to set the second hand of the hand display device to display "00" seconds within ½ seconds of the time the optical display device normally displays "00" seconds.

8. An electronic timepiece according to claim 7; wherein the time setting means includes means for linking the seconds time units displayed by the optical and hand display devices after setting of the seconds time units in both the first and second modes.

9. An electronic timepiece according to claim 7; wherein the time setting means includes detecting means responsive to the output signals from the frequency dividing means for detecting time units of $10^{-1}$ seconds to enable the time settings carried out in the first and second modes to be carried out within said predetermined time periods.

10. An electronic timepiece according to claim 9; wherein the time setting means includes first switch means for placing the time setting means in the first mode and second switch means for placing the time setting means in the second mode.

11. An electronic timepiece according to claim 10; wherein the time setting means includes means for controlling the circuit means to advance the second hand of the hand display device to display "01" seconds one second after operation of the first switch means when the first switch means is operated at a time when the detecting means detects time units of $10^{-1}$ seconds which are below $\frac{1}{2}$ seconds.

12. An electronic timepiece according to claim 10; wherein the time setting means includes means for controlling the circuit means to advance the seconds time units of the optical display device to display "01" seconds one second after operation of the second switch means when the second switch means is operated at a time when the detecting means detects time units of $10^{-1}$ seconds which are below $\frac{1}{2}$ seconds.

* * * * *